United States Patent [19]

Dullien et al.

[11] Patent Number: 4,953,619

[45] Date of Patent: Sep. 4, 1990

[54] ENHANCED OIL RECOVERY PROCESS

[75] Inventors: Francis A. Dullien; Ioannis Chatzis; Ian F. Macdonald, all of Waterloo, Canada

[73] Assignee: University of Waterloo, Waterloo, Canada

[21] Appl. No.: 422,503

[22] Filed: Oct. 17, 1989

Related U.S. Application Data

[63] Continuation-in-part of Ser. No. 377,775, Jul. 7, 1989, abandoned, which is a continuation of Ser. No. 268,603, Nov. 7, 1988, abandoned, which is a continuation of Ser. No. 106,792, Dec. 13, 1987, abandoned.

[30] Foreign Application Priority Data

Oct. 10, 1986 [GB] United Kingdom ..... 8624387

[51] Int. Cl.[5] ..... E21B 33/138; E21B 43/12; E21B 43/16

[52] U.S. Cl. ..... 166/265; 166/50; 166/268; 166/292; 166/305.1

[58] Field of Search ..... 166/50, 105.5, 242, 166/268, 273, 274, 305.1, 265, 266, 292

[56] References Cited

U.S. PATENT DOCUMENTS

| | | | |
|---|---|---|---|
| 1,093,031 | 4/1914 | Brown | 166/268 |
| 1,099,170 | 6/1914 | Dunn | 166/268 |
| 1,252,557 | 1/1918 | Dunn | 166/268 |
| 1,816,260 | 7/1931 | Lee | 166/50 |
| 1,826,371 | 10/1931 | Spindler | 166/268 |
| 2,171,416 | 8/1939 | Lee | 166/50 |
| 2,335,558 | 11/1943 | Young | 166/228 |
| 2,725,106 | 11/1955 | Spearow | 166/268 |
| 3,084,743 | 4/1963 | West et al. | 166/273 |
| 3,123,134 | 4/1960 | Kyte et al. | 166/268 |
| 3,500,914 | 4/1967 | Petteway | 166/268 |
| 4,171,017 | 10/1979 | Klass | 166/266 |
| 4,241,787 | 12/1980 | Price | 166/265 |
| 4,330,306 | 5/1982 | Salant | 166/105.5 |
| 4,392,531 | 7/1983 | Ippolito | 166/51 X |
| 4,649,998 | 3/1987 | Friedman | 166/294 |

OTHER PUBLICATIONS

Secondary Recovery of Oil in the U.S., 2nd. Ed., pp. 592, 610–614, 623–627, published by American Petroleum Institute, 1950.

*Primary Examiner*—George A. Suchfield
*Attorney, Agent, or Firm*—Sim & McBurney

[57] ABSTRACT

An enhanced oil recovery process is described wherein oil is recovered from a depleted water-wet formation by the application of a gas to the formation. The flow of gas through the formation causes oil droplets to spontaneously form an oil film on connate water, which is extruded and discharged from the pores. The films pass through the formation under the influence of gravity, gradually accumulating more oil to form an oil mass which enters the producing well bore. A sem-permeable membrane may be used to prevent the inert gas from entering the well bore from the formation.

8 Claims, 3 Drawing Sheets

PRODUCTION CHARACTERISTICS OF FREE DRAINAGE OF CONTINUOUS OIL FOLLOWED BY CONTROLLED DRAINAGE

PRODUCTION CHARACTERISTICS OF FREE DRAINAGE OF DISCONTINUOUS OIL

CUMULATIVE OIL PRODUCTION VS. TIME PLOTS IN "CONTROLLED" DRAINAGE FROM BEREA SANDSTONE CORES, FOLLOWING A WATER FLOOD.

ENHANCED OIL RECOVERY PROCESS

REFERENCE TO RELATED APPLICATION

This application is a continuation-in-part of pending U.S. patent application Ser. No. 377,775 filed July 7, 1989, (now abandoned) which itself is a continuation of U.S. patent application Ser. No. 268,603 filed Nov. 7, 1988 (now abandoned), which is a continuation of Ser. No. 106,792 filed Dec. 13, 1987 (now abandoned).

FIELD OF INVENTION

The present invention relates to enhanced oil recovery wherein oil is recovered from depleted reservoirs using a novel gas drive/gravity drainage technique.

BACKGROUND TO THE INVENTION

Enhanced oil recovery, EOR, has been the object of intensive research for the past three decades. Many EOR processes are aimed at recovering more oil from "depleted" reservoirs which still contain as much as 50% or more of the original oil in place. The overall picture of the technological and economical feasibility of EOR processes aimed at recovering more oil from "depleted" reservoirs that has emerged is one of great complexity of the processes, coupled with an uncertainty of achieving enhanced oil recovery at all, let alone in an economical manner. One of the major problems faced by many EOR processes is the possible loss of the chemicals and/or solvents injected, either by adsorption on the rock surface or by channeling and consequent bypassing of the oil to be recovered. In other words, the sweep efficiency of an EOR process may turn out to be far less than expected or desired. Some techniques aimed at permeability and/or mobility control appear to be more promising.

At the present time, crude oil prices have decreased significantly as a result of an "oil glut". Under these conditions, the necessity for EOR processes may be considered unnecessary. However, EOR process are important since:

(i) the world-wide oil shortage of crude existing just a few years ago is likely to reappear before long, (ii) domestic production in Canada and in the U.S.A. is far from adequate to cover the needs of these countries and, if overseas imports of crude were ever cut off, production would have to be increased by any and all means available at that time, and (iii) conventional sources of crude oil will gradually run out world-wide and then there will be a tremendous incentive to recover the vast resources of crude which will be still present in the "depleted" reservoirs all over the world.

Certain prior art has come to the attention of the applicant relating to oil recovery procedures as a result of prosecution of the precursor applications, namely:

| | | |
|---|---|---|
| U.S. | 1,093,031 | Brown |
| | 1,099,170 | Dunn |
| | 1,252,557 | Dunn |
| | 1,816,260 | Lee |
| | 2,171,416 | Lee |
| | 1,826,371 | Spindler |
| | 2,335,558 | Young |
| | 2,725,106 | Spearow |
| | 3,084,743 | West et al |
| | 3,123,134 | Kyte et al |
| | 3,500,914 | Petteway |
| | 4,171,017 | Klass |

-continued

| | | |
|---|---|---|
| | 4,241,787 | Price |
| | 4,330,306 | Salant |

Secondary Recovery of Oil in the United States, Published by the American Institute, 1950, pp. 592, 610–614, 623–627.

A variety of procedures are described in this material. The two Lee patents and the two Dunn patents employ the use of pressurized gas to force oil out of depleted formations. Salant, Young, Klass and Price all employ semi-permeable membranes in the separation of oil from gases. Spearow discloses the application of pressure to the top of a formation to cause liquid in flow through a said formation.

SUMMARY OF INVENTION

The present invention provides a novel EOR method in which a gas, particularly an inert gas, such as nitrogen gas, is employed as the displacing fluid to displace oil trapped in a water-wet porous formation.

In accordance with the present invention, there is provided a method for recovery of oil from a water-wet porous formation containing oil, particularly trapped oil, comprising a number of steps. Nitrogen or other gas is introduced into an upper end of the formation to permit the gas to enter and pass through pores in the formation containing water and the oil. The oil is mobilized by spontaneous spreading to form an oil film on water in the pores upon contact with the inert gas. The oil films are drained by gravity from pores filled with inert gas.

As the formation is descended, the oil films gradually accumulate more oil and form a continuous oil mass migrating downwardly in the formation. Ultimately, the continuous oil mass is discharged from the formation into a subterranean cavity, from which the oil can be removed by conventional means. The rate determining step of the process is the gravity drainage of the oil film.

The condition of spreading of oil over water in the presence of gas is best treated in terms of the spreading coefficient, as defined by the equation:

$$S'_{o/w} = \sigma' wg - \sigma'_{og} - \sigma' ow$$

where $S'_{o/w}$ is the spreading coefficient of oil over water and $\sigma'_{wg}$, $\sigma'_{og}$ and $\sigma'_{ow}$ are the interfacial tensions that correspond to the condition whereby all three fluids are in thermodynamic equilibrium, and wherein $\sigma'$wg is the interfacial tension between the water (w) and gas (g) phase, $\sigma'$og is the interfacial tension between the oil (o) and gas (g) phase and $\sigma'$ow is the interfacial tension between the oil (o) and water (w) phases. The spreading coefficient can be a positive or a negative value depending on the values of the respective interfacial tensions. When the spreading coefficient is positive, then oil spreads over water while, when the spreading coefficient is negative, the equilibrium state reached by placing a drop of oil over water consists of a monolayer of oil and a lens of oil.

The procedure of the invention is particularly concerned with the recovery of residual oil trapped in pore spaces in water wet formation, but the principles thereof are applicable to oil recovery commencing at any oil saturation of a water-wet formation. The procedure is quite different from conventional secondary oil recovery processes which employ pressurized air, as described in some of the prior art cited above.

In the present invention, advantage is taken of the phenomenon that spontaneous oil film formation on connate water, generally brine, occurs upon contact with the gas in the pores under the conditions of a positive spreading coefficient and the films so-formed can drain by gravity through the formation, whereas prior processes rely on gas pressure to mobilize the oil.

In this invention, oil in the formation, particularly, oil blobs trapped in the formation at water flood residual oil saturation, is mobilized and coalesced. No chemicals or viscous drag forces are required. The oil blobs are made mobile entirely by capillary forces at extremely low gas flow rates.

Operation of the procedure of the present invention results in rich oil recoveries before the onset of production of gas if the oil and brine are permitted to drain only by gravity and are not forced out by applying a high pressure differential on the gas.

A semi-permeable membrane may be employed, if desired, at the producing wells to prevent production of gas but to permit the passage of oil, brine or other wetting fluid.

This novel method of oil recovery provides certain advantages over existing EOR methods, as will become apparent below. The EOR method is particularly suited, but not limited to, application for horizontal producing wells.

GENERAL DESCRIPTION OF INVENTION

Figure 1:
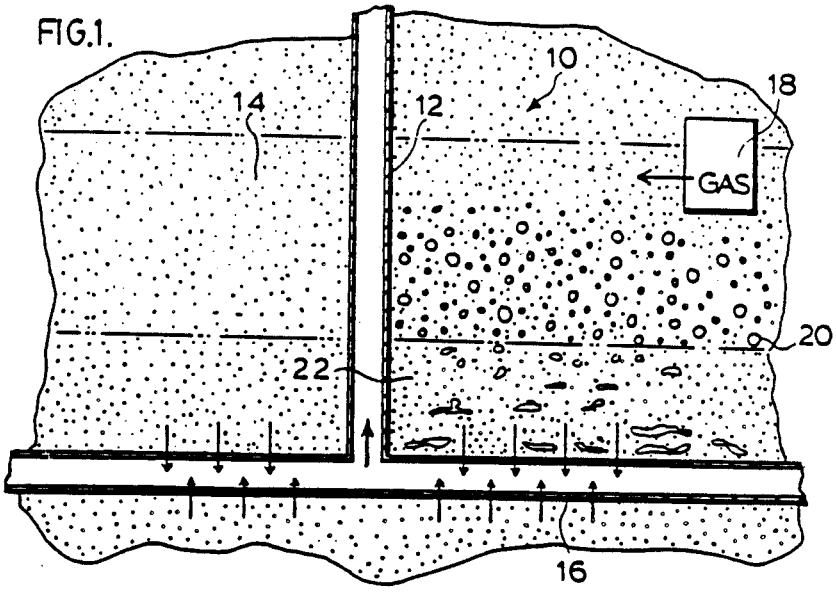
FIG. 1 is a sectional view of a residual oil bearing formation treated in accordance with one embodiment of the invention.

In the process of the present invention, a gas, particularly an inert gas, such as nitrogen, is injected into the water-wet oil-bearing formation near the top of the producing strata, at a low pressure differential. The gas fills the pores in the formation at the rate at which these are vacated by water and/or oil as they drain through the formation under the action of gravity.

Generally, the downward gas flow rate varies from about $10^{-2}$ ft/day to about 1 ft/day. The injection of gas at these low flow rates into the top of a formation at residual (or other) oil saturation results in the displacement of oil trapped or otherwise present in the pores in the form of a film between the connate water and the gas.

In an individual pore containing water, first the water "leaks" past the oil until direct contact between the gas and the oil is established. Upon such contact, oil spontaneously spreads into an oil film located between the gas and the water and the oil film is displaced from the pore under the influence of capillary forces. Such spontaneous spreading occurs when the spreading coefficient, determined as described above, is positive. The oil films then undergo gravity drainage through the formation, accumulating more oil, and ultimately multiple numbers of the oil films merge and form an oil bank. The rate determining step is gravity drainage of the oil film. Once the oil bank is formed and continues to move by gravity through the formation, this causes the water to be drained from the formation. The oil bank itself subsequently is drained from the formation by the action of gravity. The sequential drainage of the water and oil most efficiently is effected into a horizontal producing well bore but may also be effected into a sectional well bore, if desired.

The phenomena involved in this procedure are unique in oil recovery procedures, to the knowledge of the inventors, and lead to a very efficient recovery of oil from a water-wet formation.

In one embodiment, a semi-permeable membrane may be provided between the formation and a well bore into which the oil is discharged to prevent gas break-out from the formation. The semi-permeable membrane may be, for example, in the form of a thin polymer membrane of relatively high permeability, which may be supported by being sandwiched between protective layers of foam rubber, coarse grade ceramic or porous steel or other metal, or in the form of a thin-walled tube of ultrafine grade porous ceramic, steel or other suitable material, surrounded by a protective tube of foam rubber or the like.

When employed, the semi-permeable membrane should be constructed to permit the passage of oil and brine from the formation into a well bore and to prevent the passage of gas from the formation. Numerous porous materials are readily available to be used as semi-permeable membrane, including relatively tight reservoir rock, if any, in the very reservoir where the EOR process is employed. Provided that the membrane is not too tight-pored, oil production rates may be sustained at acceptable levels by the process of the invention.

Another form of such semi-permeable membrane which may be employed comprises a filter cake deposited on the producing rock surface from a slurry of an oil-wet powder and then pressed tightly against the rock by a packer.

In forming this membrane, the filter cake preferably is deposited in stages. First, a layer consisting of relatively coarse particles is applied to the rock surface and then increasingly finer particles are deposited in further layers. In this way, a high breakthrough pressure of the membrane can be attained without face plugging of the well bore while a high permeability of filter cake can be ensured.

Since the permeability changes roughly inversely to the square of the bubble pressure (for example, doubling the bubble pressure of the membrane will cause a fourfold decrease in its permeability), it is desirable to use membranes of moderate bubble pressure and consequently, to keep the excess gas pressure relatively low in order to make acceptable flow rates on the order of 0.1 to 1 ft/day possible, based on the absolute permeability of the reservoir. Oil flow rates are determined also by the oil saturation near the production well bore.

The advantages provided by this novel EOR technique may be summarized as follows:

(1) The gas does not channel or cone at the production well, because, under conditions of gravity drainage, gravity has a strong stabilizing effect;

(2) The sweep efficiency with respect to oil trapped in the formation can be as high as 100% provided that the spreading coefficient is positive;

(3) A gas (e.g., $N_2$ or produced gas) is relatively inexpensive; and (4) Gravity segregation of the gas, coupled with the absence of coning, permits high oil saturations and concomitant high oil relative permeabilities near the production wells, in particular with horizontal producing wells.

The displacement mechanism according to the new EOR technique of the invention is drainage in which the effect of gravity is utilized to maximum advantage by the low flow rate of gas through the formation. Both the water and the oil in the reservoir are displaced uniformly and sequentially by the gas.

DESCRIPTION OF PREFERRED EMBODIMENT

Referring to FIG. 1, a depleted oil formation 10 has a bore 12 formed through a residual oil-bearing formation 14 to a horizontal producing bore 16. An inert gas, such as nitrogen, is passed from a source 18 through a brine-flooded formation 14 to form oil films on connate water in the pores from globules or blobs 20 of oil trapped in pores. The oil film so-formed flows downwardly through the formation under the influence of gravity, gradually accumulating more oil, and finally coalescing in a region 22 adjacent the bore 16. The coalesced oil mass thereafter passes into the horizontal bore 16 for ejection from the well through the bore 12.

EXAMPLES

EXAMPLE 1

Figure 2:
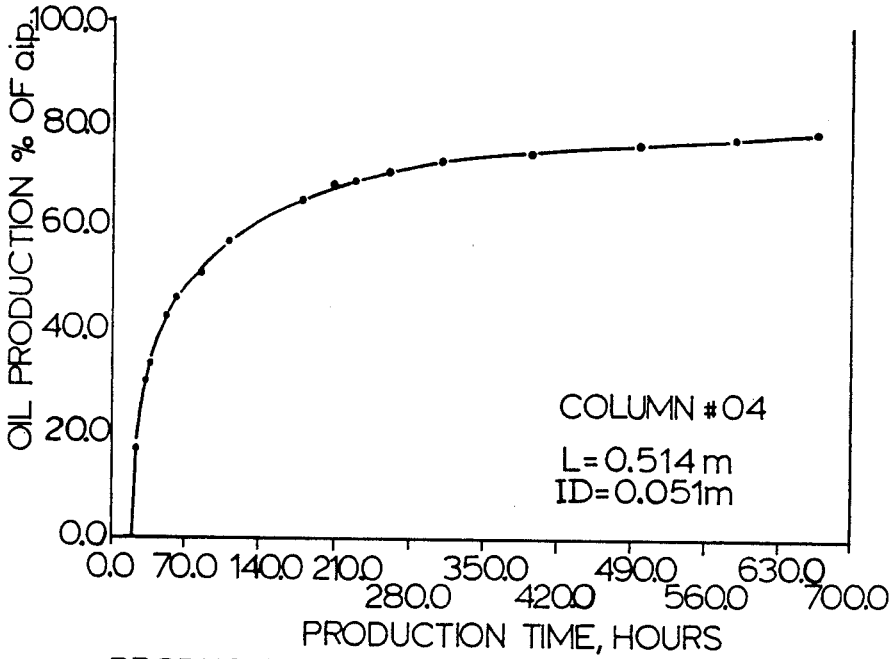

A 0.519 m tall bead pack column of 0.051 m diameter, consisting of beads of an average size of 0.49 mm, was at first saturated with water, then flooded with a refined oil of 3.2 cp viscosity in a gravity stable manner, and finally, water flooded also in a gravity stable manner, leaving a residual oil saturation of 15.8% pore volume. Afterwards the water was permitted to drain freely from the column ("free drainage"), resulting in the production of 79% of the water flood residual oil, leaving a final residual oil saturation amounting to 3.3% pore volume (see FIG. 2).

EXAMPLE 2

Figure 3:
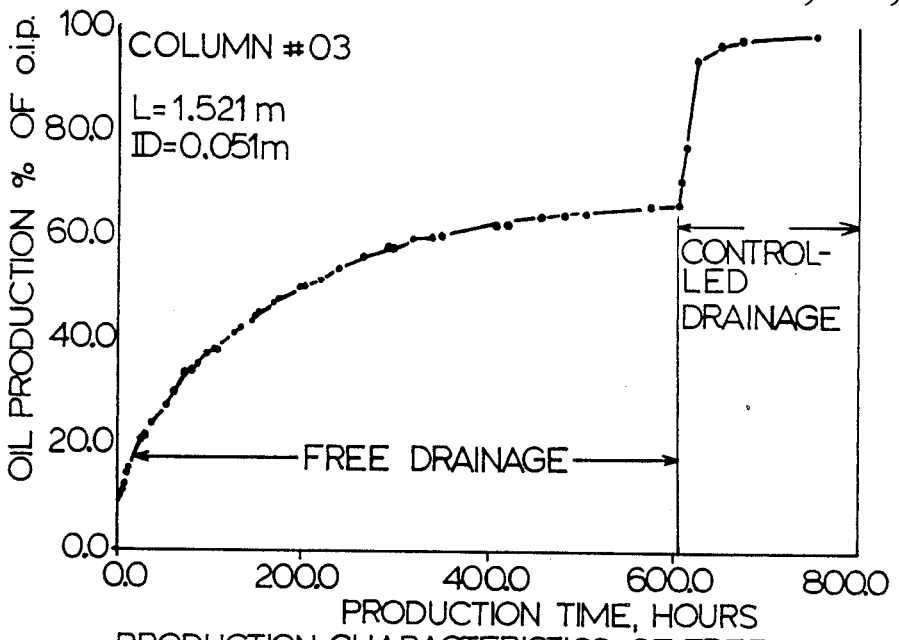
FIGS. 2 to 4 are the graphical representations of the results of laboratory drainage tests reported in the Examples below.

In this example, a "free drainage" experiment started after an oil flood (no water flood), was followed by "controlled drainage" in which a capillary barrier was placed at the bottom of the column which prevented gas breakthrough while a nitrogen pressure of 3 psig was applied to push out the oil bank remaining at the bottom end of the column after completion of free drainage. The total recovery was 98% of the original oil in place (see FIG. 3).

EXAMPLE 3

Figure 4:
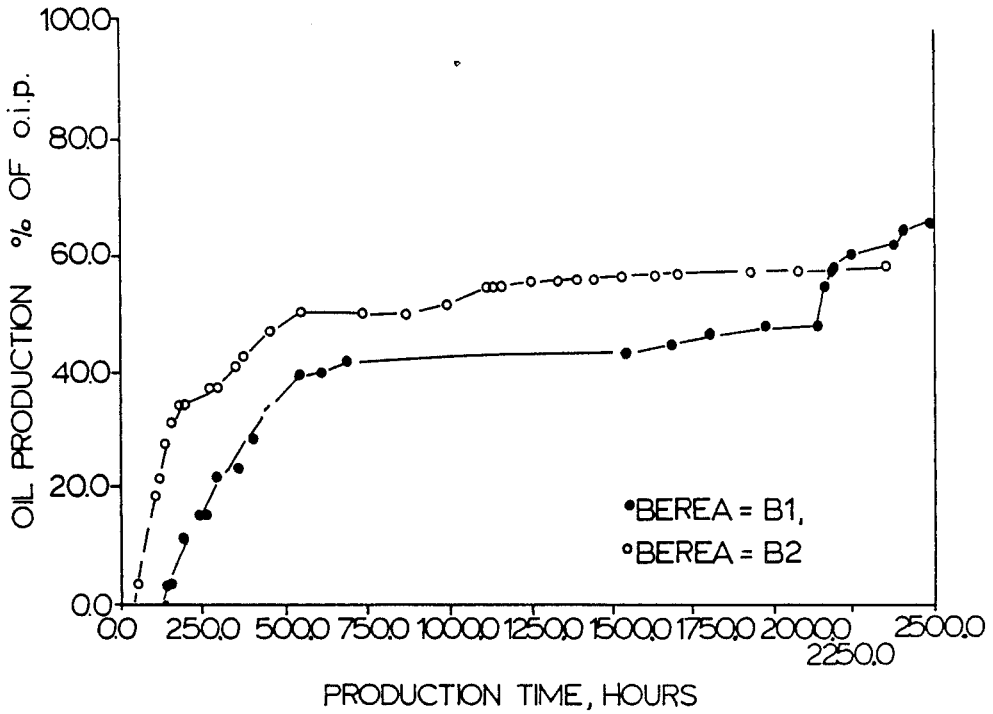

Berea sandstone cores of 0.29 m length, 0.038 m diameter and of about 400 md permeability, encased in epoxy-resin, were flooded in upright position in the same way as the glass bead column, described in Example 1, to reach water flood residual oil saturation. 2–5 psig nitrogen pressure was used in order to overcome the capillary rise of the liquids (about 40 cm) and force them to drain. A semi-permeable membrane was placed at the bottom face of the sandstone core. The production histories of two such experiments are shown in FIG. 4. The final recoveries were 60–65% of the water flood residual oil.

What we claim is:

1. A method for recovery of oil from a water-wet porous formation containing oil which comprises:

introducing a gas into an upper part of said formation to permit the gas to enter and pass through the pores at a flow rate of about $10^{-2}$ ft/day to about 1 ft/day, mobilizing said oil by spontaneously spreading to form an oil film on water upon contact with the gas, draining said oil films from pores filled with gas to pass downwardly through the formation and gradually accumulate more oil at a rate determined by gravitational forces, forming from said drained oil films a continuous oil mass migrating downwardly in the formation at a rate determined by gravitational forces, and discharging said continuous oil mass to a well bore from which the oil is recovered to a surface location.

2. The method of claim 1 wherein the water in the formation is in the form of brine.

3. The method of claim 1 wherein said oil in said formation comprises oil trapped in the pores of the formation.

4. A method for recovery of oil from a water-wet porous formation containing oil, which comprises:

introducing a gas into an upper part of said formation to permit the gas to enter and pass through the pores, mobilizing said oil by spontaneous spreading to form an oil film on water in the pores upon contact with the gas at a positive spreading coefficient for oil over water in the individual pore, said spreading coefficient ($S'_{o/w}$) being determined by the relationship:

$$S'_{o/w}=\sigma'_{wg}-\sigma'_{og}-\sigma'_{ow}$$

wherein $S'_{ow}$ is the spreading coefficient for oil (o) over water (w), and $\sigma'_{wg}$, $\sigma'$og, and $\sigma'_{ow}$ are the interfacial tensions that correspond to the condition whereby all three fluids are in thermodynamic equilibrium and wherein $\sigma'_{wg}$ is the interfacial tension between the water (w) and gas (g) phase, $\sigma'_{og}$ is the interfacial tension between the oil (o) and gas (g) phase and $\sigma'_{ow}$ is the interfacial tension between the oil (o) and water (w) phases, draining said oil films by gravity from pores filled with gas to pass downwardly through the formation and gradually accumulate more oil, forming from said drained oil films a continuous oil mass migrating downwardly in the formula, and discharging said continuous oil mass from the formation into a well bore from which the oil is recovered to a surface location.

5. The method of claim 4 wherein said gas is nitrogen.

6. The method of claim 5 wherein said gas is introduced adjacent the top of said formation to cause said flow of gas through the pores of said formation at a flow rate of about $10^{-2}$ ft/day to about 1 ft/day.

7. The method of claim 6 wherein a semi-permeable membrane is provided between said formation and said bore to permit water and said oil mass to be discharged sequentially from said formation into said bore while preventing said gas from passing from said formation into said bore.

8. The method of claim 7 wherein said semi-permeable membrane comprises a filter cake deposited on the producing rock surface of said formation from a slurry of oil-wet powder and then pressed tightly against the rock surface.

* * * * *